US006336796B1

(12) United States Patent
Cholet et al.

(10) Patent No.: US 6,336,796 B1
(45) Date of Patent: Jan. 8, 2002

(54) PROGRESSIVE-CAVITY PUMP WITH COMPOSITE STATOR AND MANUFACTURING PROCESS

(75) Inventors: Henri Cholet, Le Pecq; Eric Vandenbroucke, Nanterre, both of (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 0 days.

(21) Appl. No.: 09/588,184

(22) Filed: Jun. 7, 2000

(30) Foreign Application Priority Data

Jun. 7, 1999 (FR) ..... 99 07243

(51) Int. Cl.[7] ..... F01C 1/10
(52) U.S. Cl. ..... 418/48; 418/153; 418/179
(58) Field of Search ..... 418/48, 153, 179

(56) References Cited

U.S. PATENT DOCUMENTS 4,957,161 A * 9/1990 Cholet et al. ..... 418/48
4,991,292 A * 2/1991 Bostel ..... 29/888.023
5,145,343 A * 9/1992 Belcher ..... 418/178
5,171,138 A * 12/1992 Forrest ..... 418/178
5,562,433 A * 10/1996 Cholet et al. ..... 418/48
6,019,583 A * 2/2000 Wood ..... 418/178
6,158,988 A * 12/2000 Jager ..... 418/178
6,183,226 B1 * 2/2001 Wood et al. ..... 418/718

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

A progressive-cavity pump intended to impart energy to a fluid, includes at least a casing (1), a stator (2) and a rotor (3) arranged in the stator. The casing has at least two parts, a first part (2*a*) made of a material of low elasticity and a second part (2*b*) arranged between the inner wall (1*a*) of the housing and the first part 2(*a*), the second part (2*b*) being suited to apply and/or to maintain a stress σ exerted by the first part (2*a*) on the rotor (3) in order to obtain the pressure gain required for the pumped fluid.

8 Claims, 3 Drawing Sheets

PROGRESSIVE-CAVITY PUMP WITH COMPOSITE STATOR AND MANUFACTURING PROCESS

FIELD OF THE INVENTION

The invention relates to a <<Moineau>> type progressive-cavity pump comprising a stator consisting of at least two parts. A first part consists of a material of low elasticity, allowing notably to retain the properties of a second part. The second part is suited to provide a sufficient stress exerted by the first part on the rotor and to obtain a pressure gain required for pumping operations.

The invention is notably applied for pumping all types of hydrocarbons or aggressive products.

BACKGROUND OF THE INVENTION

Progressive-cavity pumps, or Moineau type pumps, are well-known and their method of operation has been widely described in the prior art. The pump comprises an internal gear or rotor, and an external gear or stator. Each gear has a longitudinal axis, the axes being parallel and distant from one another. The stator has one more tooth than the rotor, the latter is such that its teeth are constantly in contact with the stator. The ratio of the spiral pitch of the rotor to that of the stator is proportional to the corresponding ratio of the number of teeth of the two gears. The helical winding of the gear teeth around their axis of rotation creates, between the two gears, a volume whose length is equal to the pitch of the external gear. Provided that the spirals of the external and internal gears exhibit more than one turn, this gear layout and the respective motion thereof form closed cavities. The pump this created allows discharge of a volume of fluid under pressure without non-return valve.

In order to obtain satisfactory pressure heads, the cavities formed between the rotor and the stator must be closed with a certain sealing level. Sealing is notably provided by a negative clearance between the diameter of the section of the rotor and the dimension of the stator teeth. Maintenance of this negative clearance is provided by a certain elasticity of the rotor and/or of the stator. In order to avoid an efficiency loss notably due to the mechanical friction between the stator and the rotor as they rotate, it is wellknown to use a stator made of an elastomer and a rotor made of metal.

Moineau type pumps are well-suited for pumping certain petroleum effluents, notably viscous crudes, in well bottoms or at the surface. However, the composition of crudes known as <<light >> causes a chemical degradation of elastomers, which requires stator servicing and therefore leads to an increase in the maintenance and production costs. For effluents having temperatures above 140° C., the elastomer undergoes thermal degradation. Such a degradation can also exist when pumping a fluid with a high gas/liquid ratio as a result of heating of the gas by compression.

High temperatures or temperature rises during operation can also cause problems of adhesion of the elastomer to the metallic barrel of the pump and lead to detachment of the elastomeric part of the stator from the pump barrel.

Pumping of crudes having high temperatures, at great depths or in wells stimulated by heat for example, and pumping of effluents with a high gas proportion, under surface conditions for example, is therefore not always accessible to Moineau pumps.

SUMMARY OF THE INVENTION

The object of the present invention is an improvement of a <<Moineau >>type pump. The stator is a <<composite >>element. The word <<composite >>is used in the present description to designate the structure in at least two parts of the stator. A first part of the stator is made of a material of low elasticity, such as a metal, and a second part, in contact with the pump barrel, is selected to obtain and maintain a stress exerted by the first part on the rotor so as to generate the desired pressure gain.

The invention relates to a progressive-cavity pump intended to impart energy to a fluid, said pump comprising at least a casing, a stator and a rotor, said rotor being arranged in said stator.

It is characterized in that the stator consists of at least two parts, a first part being made of a material of low elasticity, and a second part located between the inner wall of the casing and the first part, said second part being suited to apply and/or to maintain a stress a exerted by the first part on the rotor in order to obtain the pressure gain required for the pumped fluid.

The first part can be made of a material allowing to preserve the properties of the second part.

The first part is for example made of a metal.

The second part can be made of an elastomer.

The second part is for example made from a metallic network embedded in an elastomer matrix.

The second part consists for example, totally or partially, of a fluid having a sufficient pressure for applying a required stress exerted by the first part on the rotor.

The fluid under pressure can be part of the pumped fluid.

The invention also relates to a process for manufacturing a stator consisting of at least a first part in contact with a rotor and of a second part, and intended to be used in a progressive-cavity pump.

The process is characterized in that it comprises at least the following stages:

1) placing a mandrel whose shape is selected according to the first part of the stator inside an element made from a metallic material, the assembly itself being placed in a housing provided with one or more openings, 2) applying to the element a sufficient pressure for shaping of the element, so that it moulds to the mandrel so as to form said first part, and 3) removing the mandrel.

During stage 2), a fluid under pressure can be injected between the housing and the element.

A polymerizable material is for example injected into the space formed by the housing and the outer wall of the element and the assembly is subjected to a polymerization stage so as to form the second part of the stator.

An adhesive material is for example injected prior to injecting the polymerizable material.

Means allowing heat dissipation are for example positioned between the housing and the element prior to injecting the polymerizable material and/or to centering the part in relation to the casing.

The pump and the process according to the invention are applied for pumping of a petroleum effluent or of aggressive fluids.

The pumping device according to the invention notably allows to extend the pumping range to a wider hydrocarbon range and to increase the life of the equipment.

BRIEF DESCRIPTION OF THE DRAWINGS

Other features and advantages of the method and of the device according to the invention will be clear from reading the description hereafter of embodiments given by way of non limitative example, with reference to the accompanying drawings wherein.

Figure 2:
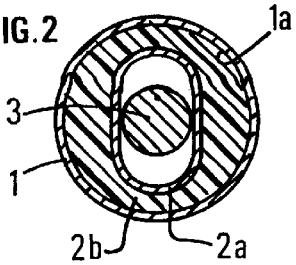
FIG. 2 shows a section of the pump according to the invention in a plane perpendicular to the axis thereof.

In this example, part 31 of the stator corresponding to part 2*a* of FIG. 2 is made of a copper alloy.

A metallic mandrel 30 is for example used, which allows to obtain the shape of part 31 of the stator that will be in contact with the rotor. The shape of the mandrel is selected according to the rotor that will be used in the final pump.

DETAILED DESCRIPTION

Figure 1:
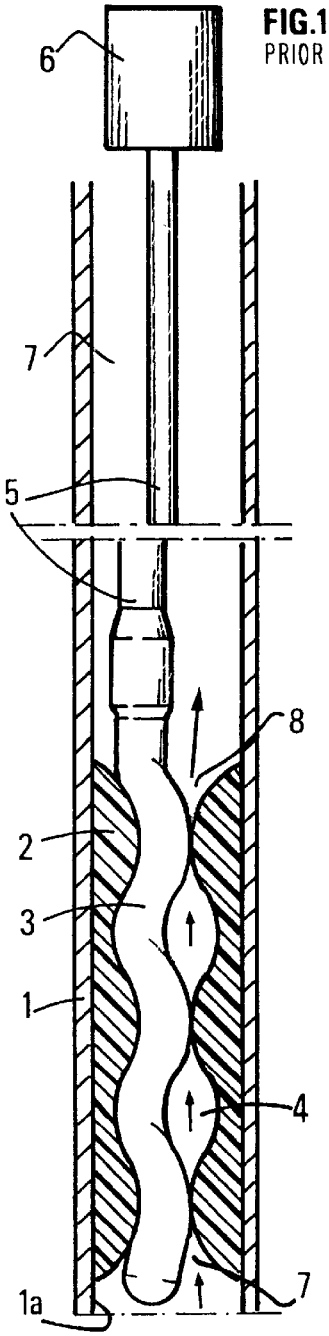
FIG.1 PRIOR ART
FIG. 1 shows the general structure of a Moineau pump according to the prior art.

FIG. 1 shows a general and well-known layout of a <<Moineau >> type pump. The pump comprises a barrel or casing 1, generally made of metal, wherein the effluent to be pumped circulates. This pump barrel notably contains:

- a stator 2 in contact with the inner wall 1*a* of the casing,
- a generally metallic rotor 3 placed inside the stator,
- the shape of the stator and the shape of the rotor, as well as the dimensions thereof, are such that the rotation of the rotor in the stator generates closed cavities 4 that move along the rotor. This motion allows the pumping function to be fulfilled,
- an element 5 connecting the rotor to a device 6 for driving it in rotation, arranged outside the casing for example, provides the rotating motion.

Element 5 is selected to compensate for the difference in the nature of the motion between driving device 6 and the hepicycloidal motion of rotor 3. This element can be a flexible device or a Cardan link.

Casing 1 is provided with at least one opening 7 for delivery of the fluid to be pumped, to which a certain quantity of energy is to be imparted, and with a passage or opening 8 for discharge of the fluid that has acquired energy.

The present invention is an improvement of the Moineau type pumps existing in the prior art.

FIG. 2 diagrammatically shows a specific layout of the pump according to the invention, notably the structure of its stator.

Stator 2 consists, for example, of two parts 2*a* (first part) and 2*b* (second part). First part 2*a* is for example made of a material of low elasticity, its main function is to preserve the qualities of second part 2*b* in contact with the inner wall 1*a* of the casing. Part 2*b* is suited to obtain and preserve, in the course of time and during operation, a stress exerted by part 2*a* on the rotor in order to sustain the negative clearance existing between the stator and the rotor, this clearance being necessary for generation of the pressure gain required for the fluid to be pumped.

Part 2*b* can be made in many different ways some of which are detailed hereafter by way of non limitative example. This part 2*b* can be made from an elastic material such as an elastomer or a compressible or incompressible fluid.

Figure 3:
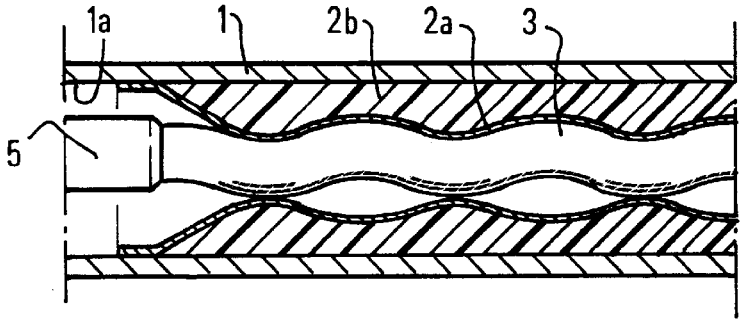
FIG. 3 is a cross-sectional view of the pump according to the invention.

FIG. 3 shows a variant where:

- part 2*a* of the stator is made of metal, for example a copper alloy, and
- part 2*b* of the stator is made of an elastomer.

Rotor 3 is for example made from a chromium-plated metal or from a chromium metal.

Such a layout allows to reduce or even to eliminate the chemical degradation of the stator and to preserve the stress exerted by part 2*a* on the rotor, which is necessary for the pressure gain required during the pumping operation.

Figure 4:
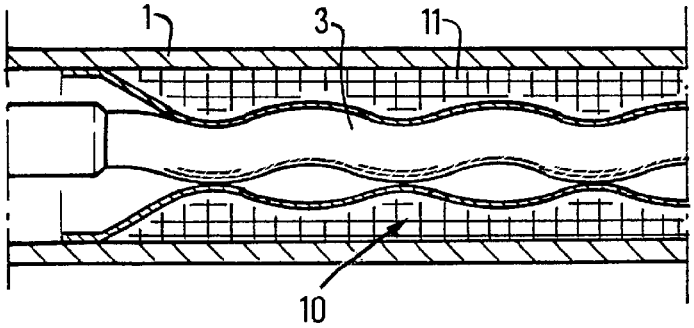
FIG. 4 shows a variant where the stator comprises a metallic network inserted in an elastomer matrix.

FIG. 4 shows another variant where:

- part 2*a* of the stator is made of a metal, for example a copper alloy, and
- part 2*b* consists of a metallic network 10 and of an elastomer 11. The metallic network is for example embedded in the elastomer matrix. Metallic network 10 notably allows dissipation of the heat accumulated in matrix 11, towards the wall of casing 1. Its function is also to center part 2*a* of the stator in relation to casing 1.

Such a layout advantageously prevents thermal and chemical degradation of the elements that make up the pump. The temperature increase in the pump is for example due to the temperature of the effluent pumped or to the proportion of gas present in the fluid.

It also affords the advantage of maintaining centering of part 2*a* for pump manufacturing processes comprising a stage of elastomer injection.

Rotor 3 is for example made of chromium metal.

Figure 5:
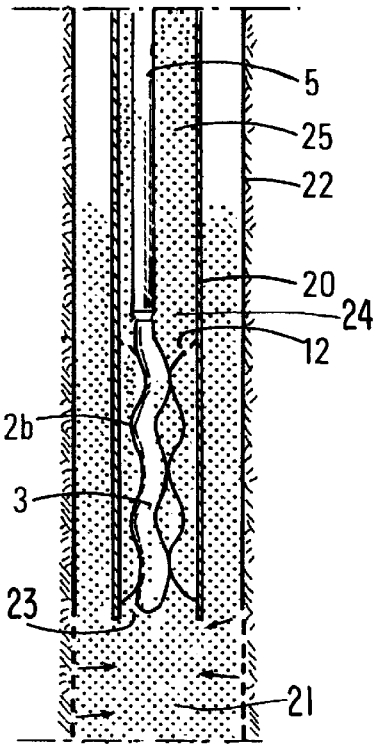
FIGS. 5 and 6 show a pump and a detail of the pump according to the invention, using part of the pumped fluid for the stator, FIGS. 7 and 8 diagrammatically show two variants of the pump mentioned in FIG. 5, and FIGS. 9 to 11 diagrammatically show an example of manufacturing stages.
Figure 6:
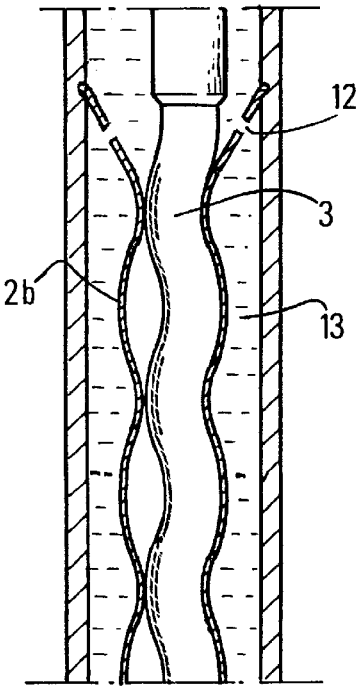

FIGS. 5 and 6 show a variant where:

- part 2*a* of the stator is made of a metal, for example a copper alloy, and
- part 2*b* consists for example of a fluid. This fluid provides the required stress exerted on part 2*a* in order to maintain sealing between the rotor and the stator, as well as the pressure gain required for the fluid to be pumped. Any compressible or incompressible fluid allowing this result to be obtained can be used.

In this embodiment, the fluid is for example part of the fluid pumped.

FIG. 5 diagrammatically shows an example of installation of a pump according to the invention in a production well.

The pump is installed at the end of a production string 20 and it is in contact with reservoir fluid 21, a hydrocarbon for example. The fluid to be pumped is fed into the pump through delivery port 23, it circulates therethrough while acquiring a certain energy value prior to being discharged through discharge port 24 and brought to the surface through annular space 25 formed by production string 20 and rod 5.

At the beginning of the pumping operation, the pumped fluid fills space 13 contained between the pump barrel and part 2*a* of the stator until this space is entirely filled (FIG. 6). This fluid is substantially at the same pressure as the pump pressure Pr. This pressure value is sufficient for part 2*a* to apply and maintain a stress on the rotor so as to sustain the negative clearance and to generate the pressure gain required in the cavities.

FIG. 6 shows a detail of the stator of the pump described in FIG. 5.

Part 2*a* comprises at least one inlet port 12 for delivery of the fluid pumped into space 13.

Part 2*a* can consist of a sheet metal of variable thickness over the length thereof. The variation of this thickness is selected by taking account of the stress variation existing along the stator. This stress variation notably depends on the pressure difference existing between space 13 and cavities 4 located between part 2*a* and rotor 3.

With this embodiment, using the pumped fluid to generate the aforementioned required stress allows automatic adjustment of this stress value during operation of the pump.

In fact, the stress exerted by the fluid present in space 13 is substantially equal to pump pressure Pr. The stress exerted on the rotor is therefore suited to the need of the pump to create the pressure gain in cavities 4.

The performances of the pump are thus preserved in time, and the wear or the chemical and thermal degradation of the elements forming the pump, notably the stator, are reduced.

The negative clearance and sealing are thus preserved as part 2*a* in contact with the rotor erodes.

According to another embodiment variant, the fluid present in space 13 is insulated from the fluid pumped. The pressure value of this fluid notably depends on the value of the pump pressure and it is controlled, for example, by means of an external equipment as described in FIGS. 7 and 8.

Figure 7:
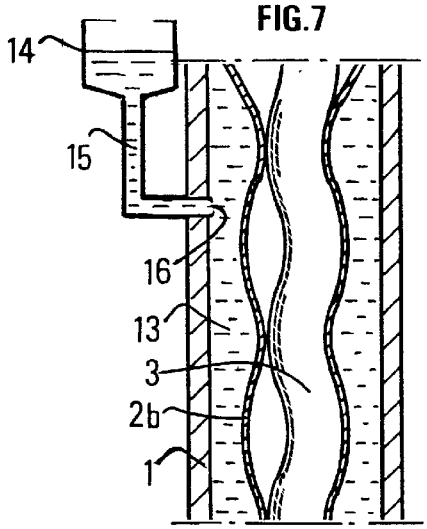

FIG. 7 describes a first embodiment where the fluid filling space 13 comes from an external source 14 connected to this space by means of a line 15 opening onto a port 16 in casing 1 of the pump. Line 15 can be equipped with suitable means known to the man skilled in the art, such as a flow-control valve and means for placing the fluid coming from the auxiliary source under pressure.

The value of the pressure is adjusted so as to optimize the stress exerted by part 2*a* of the stator on the rotor in order to reach the required pressure gain while limiting the frictional stress between part 2*a* of the stator and the rotor.

Figure 8:
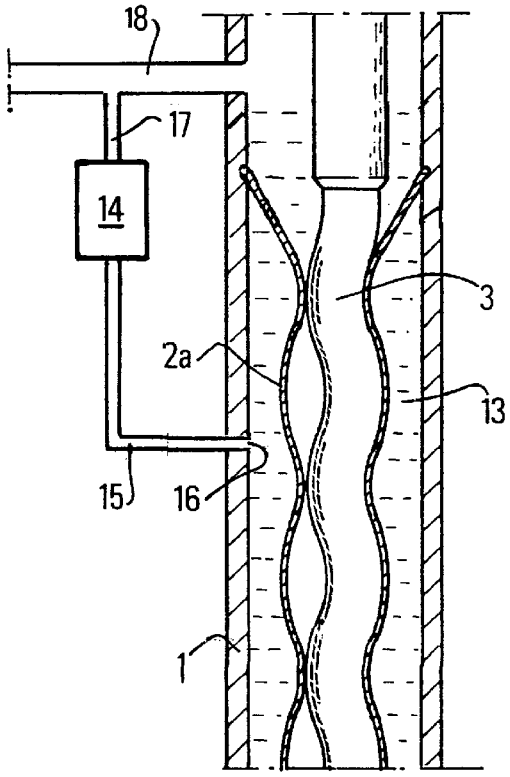

FIG. 8 shows another embodiment where source 14 containing the auxiliary fluid is connected to space 13 by a line 15 opening onto a port 16 in casing 1 and by a line 17 connected to delivery pipe 18 which communicates with the discharge port of the pump.

This embodiment notably allows the pumped fluid to be placed under a pressure that depends on the pump pressure.

Without departing from the scope of the invention, and according to another embodiment, not shown in the figures, part 2*b* is for example made from a material which, under the effect of a force applied in a direction substantially corresponding to the axis of the pump, distorts and applies a transverse stress to the rotor. Sealing between the rotor and the stator and the pressure gain required for pumping of the fluid are thus provided.

Figure 9:
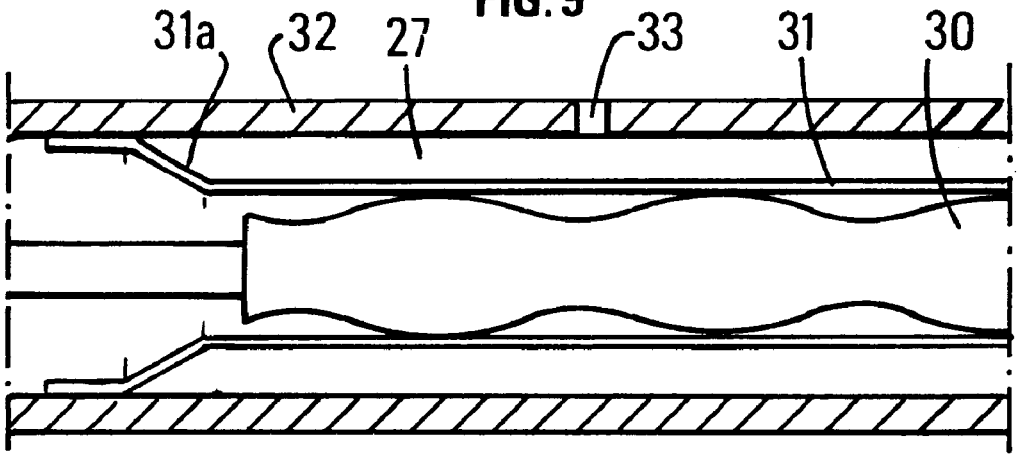
Figure 10:
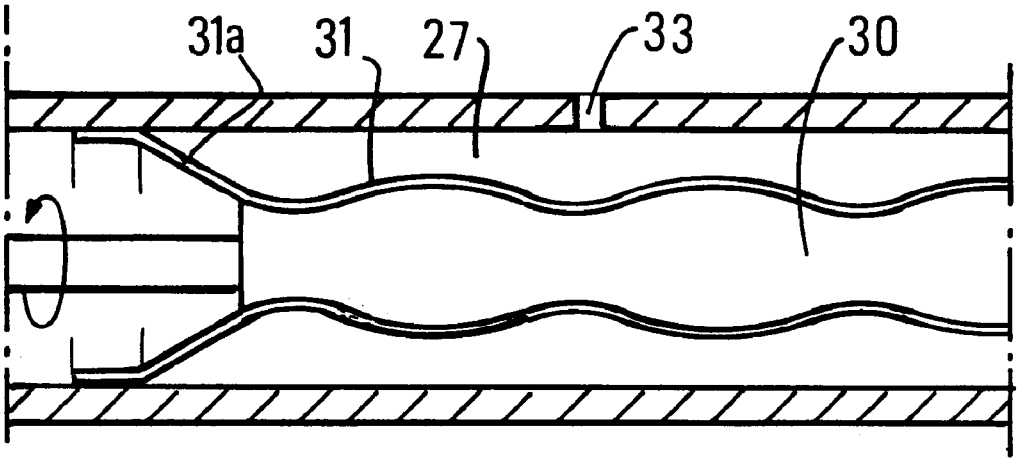
Figure 11:
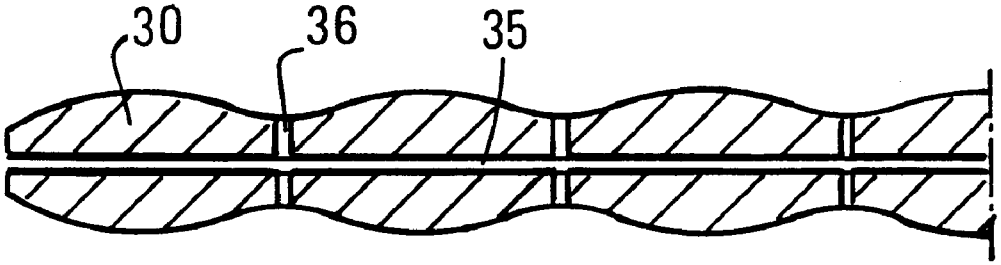

A pump according to the invention can be manufactured in many different ways one of which is given hereafter by way of non limitative example in accordance with FIGS. 9 to 11.

The following stages are for example carried out:

1) mandrel 30 is fed into an element 31 having a substantially cylindrical shape over most of its length and two ends 31*a* of substantially conical shape, 2) the assembly (mandrel and element) is fitted into a substantially cylindrical element forming a housing 32, and which can be casing 1 of the pump. Housing 32 or casing 1 will fulfill a function similar to that of a containment chamber when the pressure required for shaping element 31 is introduced. The housing therefore comprises notably one or more openings 33, or ports communicating with the outside, allowing notably passage of a fluid. These openings are for example connected to an external source containing a fluid and means intended to place this fluid under pressure and to control the flow rate of the fluid injected into space 27, 3) the fluid d under pressure is passed through opening(s) 33 so that element 31 moulds to mandrel 30 (FIG. 10). In order to facilitate shaping of this element on the mandrel, ends 31*a* can freely rotate or be driven in rotation, 4) once the shape of element 31 eventually forming part 2*a* of the stator is obtained, an adhesive product is possibly circulated so that it covers all the walls of space 27, 5) the elastic material, an elastomer for example, is injected thereafter in order to obtain part 2*b* of the stator. The elastomer can be used in fluid or liquid form, 6) a polymerization stage is carried out in order to give the material its final shape, and 7) the mandrel is removed for example simply by unscrewing it.

FIG. 11 shows a mandrel 30 provided with various passages or openings whose function is notably to discharge the air possibly trapped between metallic element 31 and the external surface of the mandrel 30 during shaping.

There can be a passage 35 extending for example over the length of the mandrel, and several openings 36 extending in a direction substantially perpendicular to passage 35.

These circulation means 35, 36 also allow to inject a lubricating fluid between mandrel 30 and element 31 so as to separate the two elements and to facilitate unscrewing of the mandrel.

In order to manufacture the pump described in FIG. 4, an additional stage is for example carried out, which consists in removing housing 32 after the shaping stage and in setting metallic network 10. Casing 1 or the housing used is then put back in place and it is fastened again before carrying out stage 4) if it exists or directly stage 5).

Another procedure consists in placing metallic network 10 inside housing 32 prior to introducing the assembly consisting of mandrel 30 and part 31 to be shaped.

The various stages are then carried out starting from stage 1).

The stages described above to illustrate a manufacturing method can be carried out or not, according to the embodiment of the stator.

Thus, to manufacture a stator as described in FIGS. 5, 6 and 7, stages 4), 5) and 6) are not carried out.

Without departing from the scope of the invention, the structure of the stator described in the previous figures can be applied for the stator of a motor used notably in the field of drilling, for example in bottomhole applications.

The motor is connected to a drill bit according to a layout described in U.S. Pat. No. 5,171,138 for example.

What is claimed is:

1. A progressive-cavity pump intended to impart energy to a fluid, said pump comprising at least a casing, a stator and a rotor having an outer surface of metal, said rotor being arranged within said stator, characterized in that stator comprises at least two parts, a first part made of a metal and in contact with the outer surface of the rotor and a second part arranged between an inner wall of the casing and the first part, said second part at least maintaining a stress a exerted by the first part on the rotor in order to obtain the pressure gain required for the fluid pumped.

2. A pump as claimed in claim 1, characterized in that the first part allows to preserve the properties of the second part.

3. A pump as claimed in claim 1, characterized in that the second part is made of an elastomer.

4. A pump as claimed in claim 1, characterized in that the second part is made of a metallic network embedded in an elastomer matrix.

5. A pump as claimed in claim 1, characterized in that the second part comprises a fluid having a sufficient pressure value to apply a required stress exerted by the first part on the rotor.

6. A pump as claimed in claim 5, characterized in that said fluid under pressure is part of the fluid pumped.

7. Application of the pump as claimed in claim 1 for pumping of a petroleum effluent or aggressive fluids.

8. A pump as claimed in claim 1, characterized in that said second part applies the stress $\sigma$ exerted by the first part on the rotor.

* * * * *